United States Patent [19]

Perry

[11] 4,066,472

[45] Jan. 3, 1978

[54] SCRAPER NOZZLE FOR WAREWASHING MACHINE

[75] Inventor: Kenneth E. Perry, Wellesley, Mass.

[73] Assignee: Adamation, Inc., Newton, Mass.

[21] Appl. No.: 743,933

[22] Filed: Nov. 22, 1976

[51] Int. Cl.[2] ..... B05B 1/26; B08B 3/02

[52] U.S. Cl. ..... 134/34; 134/25 A; 134/72; 134/151; 239/498; 239/523; 239/524

[58] Field of Search ..... 134/25 A, 32, 34, 72, 134/151; 239/498, 523, 524

[56] References Cited

U.S. PATENT DOCUMENTS

| | | | |
|---|---|---|---|
| 963,354 | 7/1910 | Braemer | 239/498 |
| 3,067,757 | 12/1962 | Fox | 134/72 X |
| 3,267,944 | 8/1966 | Meeker et al. | 134/72 X |

FOREIGN PATENT DOCUMENTS

| | | | |
|---|---|---|---|
| 19,142 of | 1905 | United Kingdom | 239/523 |

*Primary Examiner*—Richard V. Fisher
*Attorney, Agent, or Firm*—Richard L. Stevens

[57] ABSTRACT

A scraper nozzle which provides a high pressure, uniform sheet of water. The nozzle is preferably used in the upstream portion of the prewash zone of a warewasher. Wares, such as dishes, are contacted by the sheet of water and the materials on the dishes are scraped off. The nozzle comprises a planar surface and an arcuate surface. The arcuate surface terminates in a discharge edge which is characterized by a plurality of protuberances. The water flows across the discharge edge and forms the uniform sheet of water.

14 Claims, 5 Drawing Figures

SCRAPER NOZZLE FOR WAREWASHING MACHINE

BACKGROUND AND BRIEF SUMMARY OF THE INVENTION

In commercial warewashers the steps followed in cleaning dishes, flatware, glasses, etc., generally include placing the wares in a rack and placing the rack in a dolly or on a conveyor. The operator usually prerinses the wares with a manually operable flexible spray nozzle. The purpose of this step is to remove the bulk of the accumulated foreign matter. The tray then travels through a prewash station where high speed jets of water are intended to remove the remaining accumulated foreign matter. Subsequently, the wares are washed in a wash zone and then prerinsed and finally rinsed and sterilized in a rinse zone. The number of zones may vary.

The nozzles commonly employed in the prewash zone today are high pressure nozzles which tend to clog and produce an atomized spray. With an atomized spray the bubbles coalesce on the surface of the wares, and interfere with the removal of the foreign matter. Where a steady jet of water is provided, even if it is sweeping across the zone, it does not provide substantially complete contact with the wares such as a dish. This results in wares entering the wash and rinse zones not always being completely free of foreign matter.

As stated above, the primary purpose of the nozzles in the upstream portion of the prewash zone is to remove the foreign matter or scrape the wares clean. The high pressure valves do not accomplish this result.

The present invention is directed to a nozzle which provides a high velocity sheet of water which imparts a scraping action when it contacts a surface. The nozzle distributes a wide uniform sheet of water substantially free of bubbles which sheet effectively scrapes the wares it contacts. The use of the nozzle may if desired eliminate the step of manually spraying the wares prior to the prewash step in the cleaning sequence.

My invention broadly comprises a nozzle and a method of using the nozzle which includes a baffle plate having a discharge edge characterized by a plurality of projections thereon, and means to discharge a stream of water onto a least one surface of a baffle plate. The projections result in a plurality of substantially uniform discharge pressure points to increase the velocity of the water and the water is discharged as a uniform sheet. At least a portion of the contacted surface is preferably arcuate. When the stream of water is not perpendicular to the discharge edge of the baffle plate, the upstream end of the baffle plate, in reference to the direction of discharge of the water, is diminished with reference to the downstream end.

In the preferred embodiment of my invention, the nozzle comprises a baffle plate secured to a conduit. The baffle plate includes an arcuate or concave surface terminating in a discharge edge and a substantially planar portion secured along its entire edge to the conduit such that the water discharge from the conduit flows across the planar surface and then the arcuate or concave surface and is baffled or deflected uniformly across the discharge edge. The baffle plate is diminished in cross-sectional area from the upstream end of the baffle plate to the downstream end and provides a high velocity sheet of water. The nozzle is uniquely suited for use in the prewash zone of a warewasher.

DESCRIPTION OF THE PREFERRED EMBODIMENT

Figure 1:
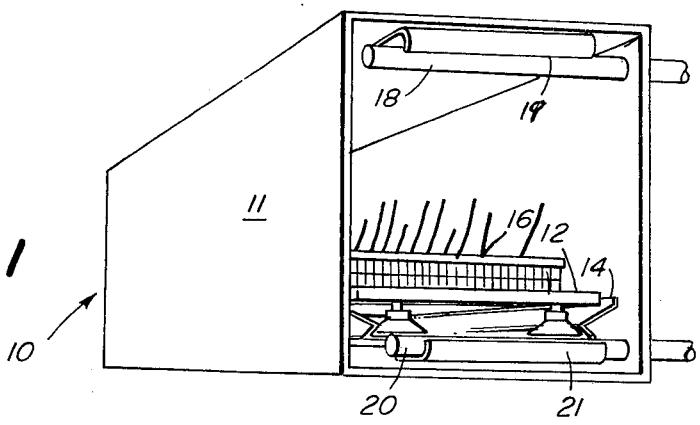
FIG. 1 is a schematic view of a nozzle embodying the invention disposed in a prewash zone of a warewasher.

The preferred embodiment of the invention will be described in reference to a scraper nozzle employed in a commercial warewasher. In FIG. 1, a portion of a commercial warewasher 10, such as an A-11 warewasher, manufactured by Adamation, Inc. of Newton, Mass. is shown. This warewasher 10 includes prewash zone 11, and wash, prerinse and rinse zones. Dollies 12 which travel on a conveyor pan 14 pass through the zones. A tray 16 having dishes thereon is disposed on the dolly 12. The warewasher, conveyor, dollies and zones are conventional and need not be described in further detail. Scraper nozzles 18 and 20 having discharge edges 19 and 21 are disposed in the upper and lower portions of the prewash zone 11. The discharge edges 19 and 21 are oriented such that the sheets of water provided are substantially perpendicular to the direction of travel of the tray. If desired, both nozzles may be oriented differently or one may be oriented differently with respect to the other. Alternatively, only one sheet nozzle need be used at any orientation. Further, any of these combinations may be used in any of the zones of the warewasher.

The scraper nozzle 20 will be described in detail, it being understood that nozzle 18 in this preferred embodiment is identical to nozzle 20.

Figure 2:
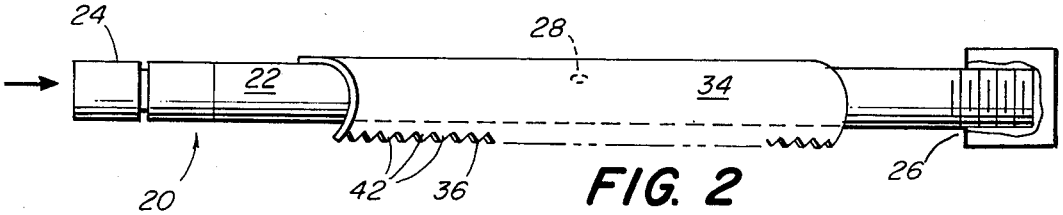
FIG. 2 is a front view of a nozzle.
Figure 3:
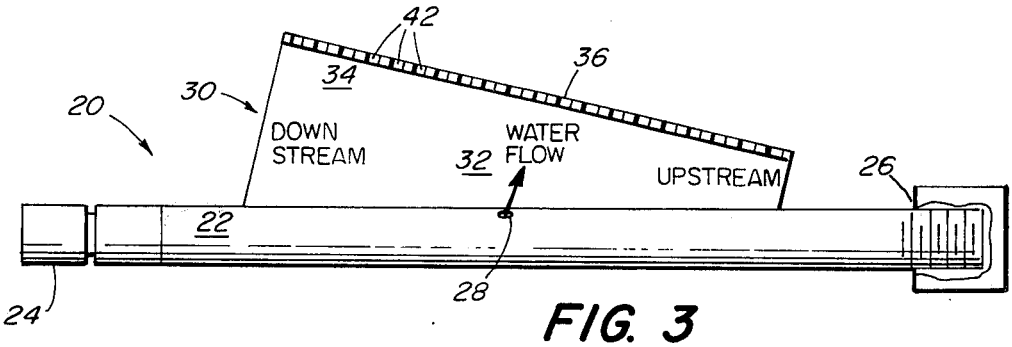
FIG. 3 is a bottom view of the nozzle of FIG. 2.
Figure 4:
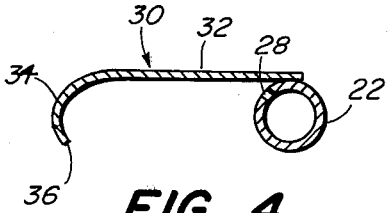
FIG. 4 is a side view of the nozzle of FIG. 1.

Referring to FIGS. 2, 3 and 4, the nozzle 20 comprises a one inch (1 inch) nominal diameter, sixteen inch (16 inch) conduit 22 secured to a suitable water supply (not shown) at one end 24 and capped at the other end 26. The conduit 22 is characterized by a three-eighths inch diameter aperture 28. Water is supplied to the conduit 22 at a flow rate of about 60 gpm and at a pressure of about 20 psig. A baffle plate 30 includes a planar portion 32 shown more clearly in FIG. 4 and an arcuate portion 34 which terminates in a discharge edge 36. The planar portion 32 is secured, such as by welding, along its entire edge to the conduit 22 such that the planar surface is opposed to the aperture 28.

More specifically, referring to FIG. 4, the centerline of the aperture 28 is approximately 50° from the vertical at which angle the water discharged from the aperture 28 strikes the underside of the baffle plate 30.

The discharge edge 36 of the baffle plate is 9 inches in length and when the plate is secured to the conduit as shown in FIG. 3 (bottom view) the edge 36 is offset in relation to the longitudinal axis of the conduit 28. As shown in FIG. 4 the edge 36 is turned 115° from the vertical forming the arcuate portion 34. This results in the edge 36 being spaced approximately two and three-quarter inches from the centerline of the conduit at the upstream end and three and one-half inches from the centerline of the conduit at the downstream end.

The discharge edge 36 includes a plurality of uniformly spaced saw teeth 42 which are one-eighth inch deep root to crest and have a 90° angle between opposed sides.

In the operation of the nozzle, water is introduced into the conduit at a flow rate of 60 gal./min. and a pressure of 20 psig and discharged from the aperture 28 striking the underside of the baffle plate 30 on the planar portion 32. Referring to FIG. 2, the flow of the water into the conduit 22 is from left to right. This unidirectional flow results in the water being discharged from the aperture 28 substantially in the direction as shown in FIG. 3, that is, at an acute angle with reference to the longitudinal axis of the conduit. The diminished cross-sectional area of the upstream end of the baffle plate results in a back pressure and redistribution of the water to the downstream end of the baffle plate with the result that the water flowing across the entire discharge edge 36 of the baffle plate is substantially uniform. The saw teeth 42 also being uniform provide for a plurality of substantially equal pressure points which increase the velocity of the water. If the teeth are too fine both the maximum velocity is not realized and the water sheets off nonuniformly. If the teeth are too wide apart then the water tends to break into separate streams and does not provide the high pressure uniform sheet of water desired.

The invention has been described in reference to a nonuniform baffle plate with water introduced at an acute angle with reference to the longitudinal axis of the conduit and a shaping of the baffle plate to provide a uniform flow distribution across the plate. The protuberances have been disclosed as being saw toothed. If desired, the protuberances may be uniformly notched, nicked, crenated, detented, toothed, palmated, serrated, scalloped, escalloped, or any combination thereof to provide the pressure points for increasing the velocity of the fluid streams discharged. The pressure and the flow rate of the fluid will vary depending upon the particular configuration.

Figure 5:
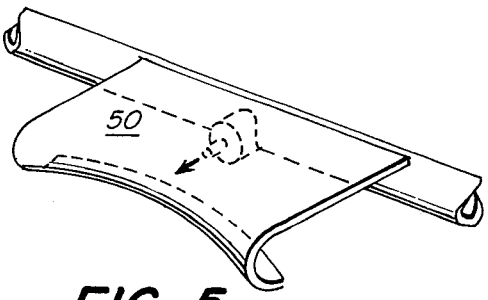
FIG. 5 is a perspective of a baffle plate used in an alternative embodiment of the invention wherein the stream is perpendicular to the discharge edge of the baffle plate.

FIG. 5 illustrates an alternative embodiment of the invention, wherein the water is discharged substantially perpendicular to the discharge edge of the baffle plate in which instance the baffle plate is necked in the center portion 50 thereof to provide the area of increased pressure and flow distribution evenly on both sides thereon. Further embodiments could include baffle plates back to back to provide sheets of water in opposed direction as will be apparent to those skilled in the art. Also, depending on the physical size and shape of the baffle plate and the pressure and flow rate of the water introduced thereon, various combinations of these disclosed protuberances and baffle plate configurations may be used.

Having described my invention, what I now claim is:

1. A scraper nozzle for use in a warewasher to remove foreign matter from a surface, which comprises:

a. a water conduit having at least one aperture for the discharge of water therefrom;

b. a baffle plate in fluid flow communication with the conduit, the plate including a discharge edge spaced apart from the conduit, said discharge edge including a plurality of protuberances thereon, the protuberances being spaced and formed to provide a substantially sheet-like discharge of water therefrom;

the baffle plate diminishing in cross-sectional area from a downstream end to an upstream end to control the flow of water across at least one surface of the baffle plate and to provide a uniform flow rate at the discharge edge, the upstream end of the baffle plate being directly opposed to the aperture for the water discharged from conduit whereby because of the dimensioning of the baffle plate a back pressure is created which results in redistribution of the water to the downstream end and the uniform discharge of water across the discharge edge.

2. The scraper nozzle of claim 1 wherein the baffle plate includes a planar portion and an arcuate portion, and the arcuate portion terminates as the discharge edge.

3. The scraper nozzle of claim 2 wherein the planar portion is opposed to the aperture for the discharged water.

4. The scraper nozzle of claim 2 wherein the arcuate portion is concave and located such that the water flows across the concave surface.

5. The scraper nozzle of claim 1 wherein the baffle plate is necked and the necked portion comprises the upstream end.

6. A method for the removal of foreign matter from surfaces, such as wares, with a scraper nozzle, the nozzle comprising a baffle plate having a planar surface and an arcuate surface, the arcuate surface terminating in a discharge edge, the baffle diminishing in cross-sectional area from a downstream end to an upstream end, which method includes:

a. discharging a stream of water onto the upstream end creating a back pressure and redistribution of the water toward the downstream end;

b. flowing the water across the entire arcuate surface;

c. discharging the water from the discharge edge in a plurality of streams of water of substantially uniform volume and velocity, the streams subsequently merging to form a uniform sheet of high velocity water; and d. contacting the surfaces to be cleaned.

7. The method of claim 6 which includes discharging the water at an angle nonperpendicular to the discharge edge.

8. The method of claim 6 which includes:

placing wares on a tray;

moving the tray along a predetermined direction to place the wares in contacting engagement with the sheet of high velocity water.

9. The method of claim 8 which includes:

contacting the wares with the high velocity sheet of water in a prewash zone of a warewasher.

10. A scraper nozzle for use in a warewasher to remove foreign matter from a surface which comprises:

a. a water conduit having an aperture therein for the discharge of water therefrom;

b. a baffle plate in fluid flow communication with the conduit, the plate including a discharge edge spaced apart from the conduit, said discharge edge including a plurality of protuberances thereon, the protuberances being spaced and formed to provide a substantially sheet-like discharge of water therefrom;

the baffle plate diminishing in cross-sectional area from a downstream end to an upstream end to control the flow of water across at least one surface thereof and to provide a uniform flow rate at the discharge edge, the plate comprising a planar portion and an arcuate portion, the arcuate portion terminating at the discharge edge, the planar portion being directly opposed to the aperture, whereby because of the dimensioning of the baffle plate a back pressure is created which results in redistribution of the water to the downstream end and the uniform discharge of water across the discharge edge.

11. The scraper nozzle of claim 10 which includes means to close one end of the conduit.

12. The scraper nozzle of claim 11 wherein the protuberances form a saw-toothed discharge edge.

13. A warewasher which comprises:

a. means to define a plurality of zones to clean wares passing therethrough;

b. means for passing a conveyor pan through the zones;

c. at least one dolly secured to the conveyor pan;

d. means to hold a plurality of wares secured to the dolly; and e. a scraper nozzle secured to one end of said zones and adapted to provide a sheet-like discharge of water to contact the wares, which includes:

i. a water conduit having at least one aperture for the discharge of water therefrom;

ii. a baffle plate in fluid flow communication with the conduit, the plate including a discharge edge spaced apart from the conduit, said discharge edge including a plurality of protuberances thereon, the protuberances being spaced and formed to provide a substantially sheet-like discharge of water therefrom;

the baffle plate diminishing in cross-sectional area from a downstream end to an upstream end to control the flow of water across at least one surface of the baffle plate and to provide a uniform flow rate at the discharge edge, the upstream end of the baffle plate directly opposed to the aperture for the water discharged from the conduit whereby because of the dimensioning of the baffle plate a back pressure is created which results in redistribution of the water to the downstream end and the uniform discharge of water across the discharge edge.

14. The warewasher of claim 13 wherein the baffle comprises a planar portion and an arcuate portion, the arcuate portion terminating as the discharge edge, the water contacting the planar portion directly.

* * * * *